US005316370A

United States Patent [19]

Newman

[11] Patent Number: 5,316,370

[45] Date of Patent: May 31, 1994

[54] SEAT ASSIST

[75] Inventor: Duncan Newman, Toronto, Canada

[73] Assignee: Newman Engineering Inc., Toronto, Canada

[21] Appl. No.: 977,209

[22] Filed: Nov. 16, 1992

[51] Int. Cl.[5] ..... A47C 1/02

[52] U.S. Cl. ..... 297/313; 297/337; 297/DIG. 10

[58] Field of Search ..... 297/DIG. 10, 335, 327, 297/313, 326, 337

[56] References Cited

U.S. PATENT DOCUMENTS

| | | | |
|---|---|---|---|
| 2,850,077 | 9/1958 | Dawson . | |
| 3,138,402 | 6/1964 | Heyl | 297/DIG. 10 |
| 3,158,398 | 11/1964 | Stryker | 297/333 |
| 3,158,399 | 11/1964 | Pragnell | 297/389 |
| 3,446,532 | 5/1969 | Cramer | 297/313 |
| 3,479,086 | 11/1969 | Sheridan | 297/330 |
| 3,479,087 | 11/1969 | Burke | 297/339 |
| 3,659,897 | 5/1972 | Wright | 297/337 |
| 3,851,917 | 12/1974 | Horstmann | 297/DIG. 10 |
| 4,031,576 | 6/1977 | Epstein | 4/251 |
| 4,249,774 | 2/1981 | Andreasson | 297/DIG. 10 |
| 4,538,853 | 9/1985 | Levenberg | 297/339 |
| 4,573,736 | 3/1986 | Levenberg | 297/339 |
| 4,574,901 | 3/1986 | Joyner | 297/337 |
| 4,581,778 | 4/1986 | Pontoppidan | 4/251 |
| 4,688,851 | 8/1987 | Whiteford | 297/313 |
| 4,690,457 | 9/1987 | Poney et al. | 297/337 |
| 4,852,849 | 8/1989 | Jones | 248/575 |
| 4,979,726 | 12/1990 | Geraci | 297/313 |
| 5,082,327 | 1/1992 | Crisp | 297/313 |
| 5,116,100 | 5/1992 | Iverson | 297/313 |

*Primary Examiner*—Paula A. Bradley
*Assistant Examiner*—James Miner
*Attorney, Agent, or Firm*—Dowell & Dowell

[57] ABSTRACT

A portable seating assist device for use on a wide range of seating furniture comprises a base portion to be placed on the horizontal surface of a chair or the like and a seating surface which is hingedly mounted to the base. A compression spring is mounted between the seating surface and base to urge the two apart an allow upwardly assisted motion between a closed and open position. The seating surface is hinged in two sections so that the rear section forms a stable platform in the raised position. Levers at the front corners of the seating surface assist in initiating the lifting action.

7 Claims, 4 Drawing Sheets

SEAT ASSIST

BACKGROUND OF THE INVENTION

This invention relates generally to portable devices which can be used on a broad range of seating furniture to assist an elderly, infirm, handicapped or overweight person in gently sitting down and rising from the seated position.

Dedicated furniture to accomplish this is well known and this field consists in the main of chairs having moving seats which are powered electrically or by fluid power. Another type of such furniture uses passive energy storage elements such as springs to support the person during seating and to urge the person upwards when rising.

Portable devices that can be used on conventional seating furniture are also known to exist and these too are either powered or passive. These portable devices have the advantage over dedicated furniture of lower cost and versatility in that the user may quickly transfer the device from chair to chair and even take it travelling.

The passive, spring-based systems are simpler and less expensive than the powered ones. They also are free of the need for electrical connections and have the advantage of ease of control if properly designed, since an electrically powered seat lift must for safety move at a fixed slow rate of speed. The passive arrangements do, however, ideally require some form of adjustment to match the spring forces to the weight of the occupant. Spring assisted chairs of dedicated construction are generally shown in the following U.S. Pat. Nos. 4,538,853 and 4,573,736 to Levenberg; U.S. Pat. No. 4,690,457 to Poncy et al. U.S. Pat. No. 4,852,849 to Jones and U.S. Pat. No. 4,979,726 to Geraci.

Spring-assisted portable seat assist devices have been generally shown in the following U.S. Pat. No. 5,082,327 to Crisp; U.S. Pat. No. 4,688,851 to Whiteford; U.S. Pat. No. 3,659,897 to Wright.

These arrangements contain certain deficiencies whose resolutions are objects of this invention. Known spring-assisted arrangements, both in dedicated furniture and portable form, generally have a latch mechanism for releasably securing the seating member to allow the springs to assist the occupant in rising. These known latching arrangements require the user to activate the latch manually before rising. Since the typical user of such a device is physically impaired, it is desirable that they have both hands free to steady themselves on the arms of the chair or on a walker or a cane or other suitable handle as they rise. Latching devices can impair this freedom. In addition, latching systems have disadvantages relating to safety and convenience: in order to collapse the device for transportation or storage, (or in the case of dedicated furniture, for use as a normal chair) large amounts of energy must be stored in it before latching the seat in the down position. This presents the hazard of accidental unlatching. Furthermore, in the case of adjustable arrangements, a lighter person may sit on the latched device than the person for whom the spring forces were set, giving rise to the hazard of an overly energetic lift.

The known spring-assisted arrangements typically use a moving seat element which is an upholstered flat and rigid panel mounted pivotally to the front edge of a base element or the chair structure. When the seat is in the fully lifted position it is therefore at a considerable angle to the horizontal, thus a substantial component of the lift force is forward rather than upward and the chair may slide away from the occupant if not blocked from moving on the floor. In addition, the slope of the seat may cause the impaired person to slide down it.

Accordingly, it is seen that a there still exists a need for a portable passive seating assist apparatus which has a stable seating surface and which is safely and easily used by the physically infirm.

It is an object of this invention to safely assist an infirm person in sitting down and rising from a conventional chair, couch, bench, wheel chair or the like.

It is also an object of this invention to provide a device which is inexpensive, simple, lightweight and provides a comfortable and stable seating surface at all stages of the lifting action.

It is a further object of this invention to provide a lifting device which is so configured as to not require a latch in the closed position.

It is a further object of this invention to provide an adjustable spring assembly which can be quickly changed to suit persons of various weights and infirmities and which can be deactivated to enable easily collapsing the device for storage and transportation.

Additional objects and advantages of the invention will be set forth in part in the description which follows and in part will be obvious from the description, or may be learned by practice of the invention.

SUMMARY OF THE INVENTION

According to one aspect of the present invention, there is provided an apparatus for a chair comprising: a base; a seat mounted to the base and having an occupant assisting section and a front section; the occupant assisting section being movable between a lowered position where it forms a seating surface with the front section of the seat and an elevated position where it is distanced upwardly and forwardly from its lowered position at an orientation horizontally-suitable for seating; a power source that normally urges the occupant assisting section into the elevated position, the power source having a magnitude that is overcome by the weight of an occupant as he sits in the chair and that assists an occupant to rise from the chair as the chair reassumes the elevated position.

According to another aspect of the present invention, there is provided a chair having: a seat that moves between an elevated position from a seated position, said seat having a front section that swings upwardly to raise the seat and a occupier-assisting section that remains horizontally-suitable for seating to continuously support the occupant; a power source that normally moves the seat to the elevated position, the power source having a magnitude that is overcome by the weight of an occupant as he sits in the chair to actuate the seat to the seated position and that assists an occupant to rise from the chair as the chair reassumes the elevated position.

According to yet another aspect of the present invention, there is provided in a chair, an apparatus comprising: an elevatable seat having two sections, one of said sections being an elevator section and the other of said sections being an occupant-assisting section; the elevator section of said seat being mounted on said base for movement between an elevated position and a seating position; means operable between the base and the occupant-assisting section for maintaining the occupant-assisting section suitably horizontal for seating as the elevator section moves between the elevated position and the seating position; a power source mounted on the base for normally urging the elevator section to an elevated position, said power source having a magnitude that is overcome by the weight of an occupant as he sits in the chair to move the elevator section from an elevated position to a seating position, and that assists an occupant to rise from the chair as he rises from the chair.

In an enhancement to the invention which is best used on conventional seating furniture having no arms, lever means are provided and attached to the underside of the front corners of the forward section which is, in the preferred embodiment, made of a flexible material so that in the lowered position, the front corners flex up. As the user presses down on the corners, the lever means bear on the base and pry the seating element away from the base thus initiating the lifting action and allowing the spring to exert its full force to continue the lift.

BRIEF DESCRIPTION OF THE DRAWINGS

The invention will be readily understood after reading the following description given in conjunction with the accompanying drawings in which.

DESCRIPTION

Figure 1:
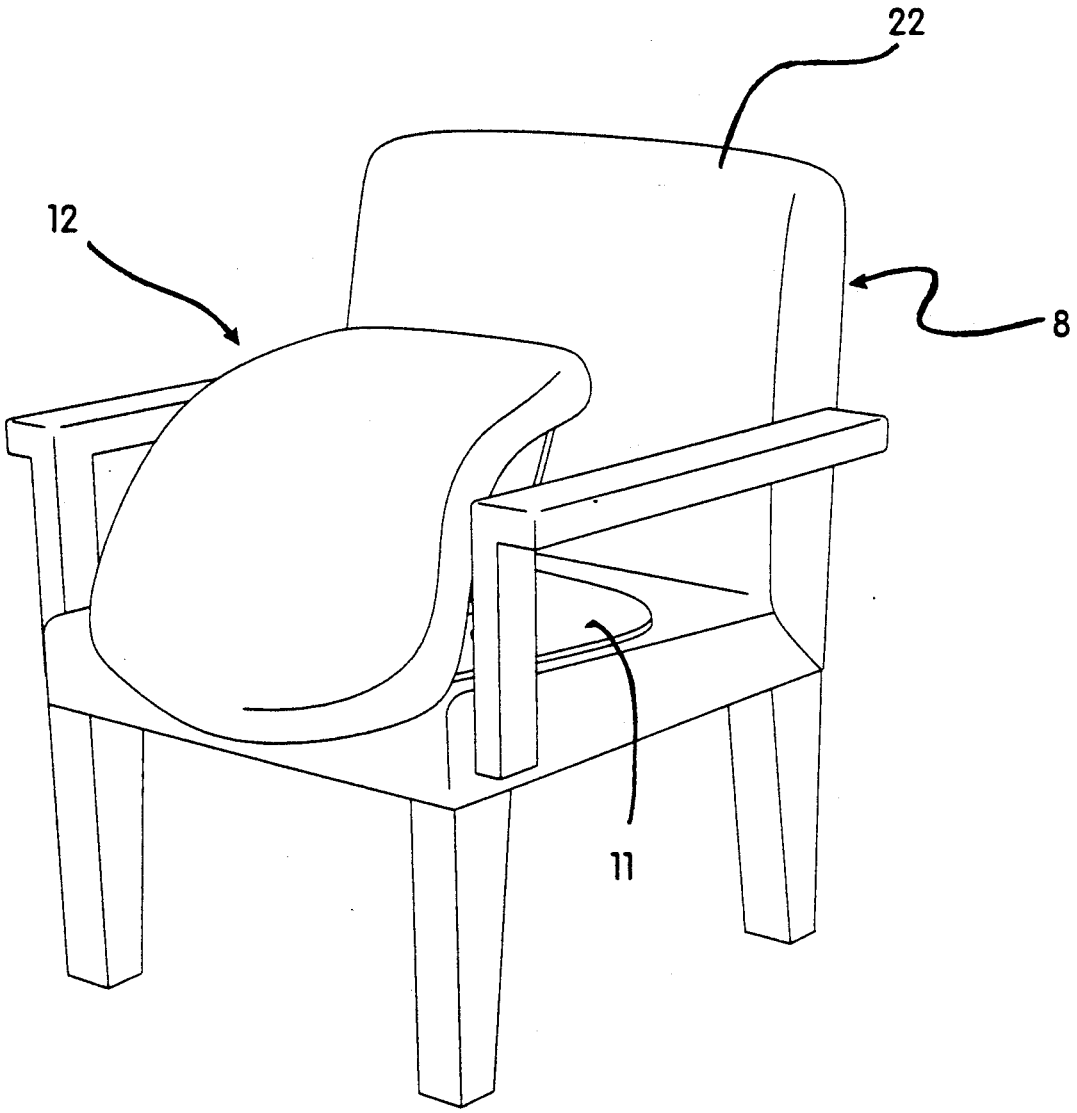
FIG. 1 is a perspective view showing the preferred embodiment of this invention mounted on a conventional chair.

Referring to the drawings, a chair is shown in FIG. 1 with a preferred embodiment of the invention mounted thereon. The embodiment shown is an apparatus used to assist people in sitting down and getting back up out of the chair. The assistance is provided by the occupant assisting section 15 which is raised to the elevated position, shown in FIG. 4, when the occupier is not sitting in the chair and is lowered to the seating position, shown in FIG. 2, by the weight of the occupier during use. The apparatus includes a power source that normally urges the occupant assisting section into the elevated position. The power source is of a magnitude that is overcome by the weight of an occupant as he sits in the chair, but is sufficient enough to assist the occupant to rise from the chair.

Reference is now made more particularly to the drawings which illustrate the preferred method for carrying out the invention and wherein similar reference characters indicate the same parts throughout the several views.

The seating assist construction includes a base 11 and a seating surface 12. The seating surface advantageously may include an upholstered cushion portion 13 and a support element comprising a front section 14 and occupant assisting section 15. In the preferred embodiment, the forward and occupant assisting sections are each portions of a single flexible platform element. This platform is best composed of a thermoplastic or other material which can endure the repeated flexure occurring at the flexible hinge region 17. The front section, if composed of such material, is supported by a stiffener 18, indicated in FIG. 5, having two extending forward arms 19. Formed in the extending forward arms 19 are through holes through which the front pivot 20 passes and by which it is hingedly-connected to the base 11 on a transversly extending axis.

The base 11 can have advantageously mounted to it a layer of non-skid material for enhancing the security of the device's placement on the piece of seating furniture which in this example is a chair 8.

The stiffener 18 and base 11 are further connected by a compression spring 23. In the preferred embodiment, this spring advantageously incorporates damping means which limits its speed of extension. Such a spring is also advantageously chosen to be one which is prestressed at its elevated position to afford a substantial force at all positions. Gas-filled springs or struts conventionally fit these requirements.

Figure 5:
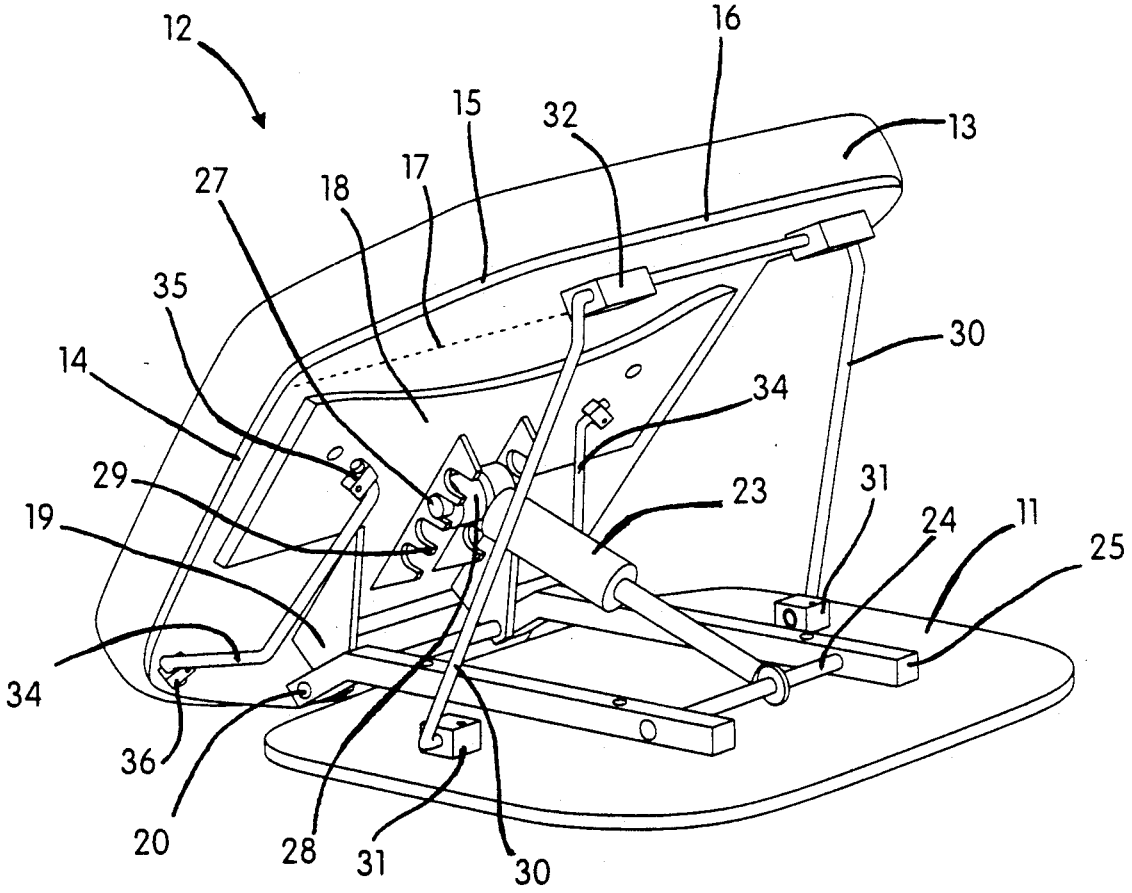
FIG. 5 is a perspective looking at the back of the preferred embodiment when the occupier-assisting section is in its elevated position.

As shown in FIG. 5, the front pivot of the spring 23 is fitted permanently with a front spring pin 27 having two permanently fixed bushings 28 at either side. The stiffener 18 in this embodiment incorporates a double row of teeth 29. The spaces between adjacent teeth form a recess to receive the front spring pin 27 and the bushings 28 ensure that the spring is centred between the rows of teeth and allow the spring to freely pivot between them. In the preferred embodiment, forming each row of teeth with five such recesses has been found to be suitable.

Figure 2:
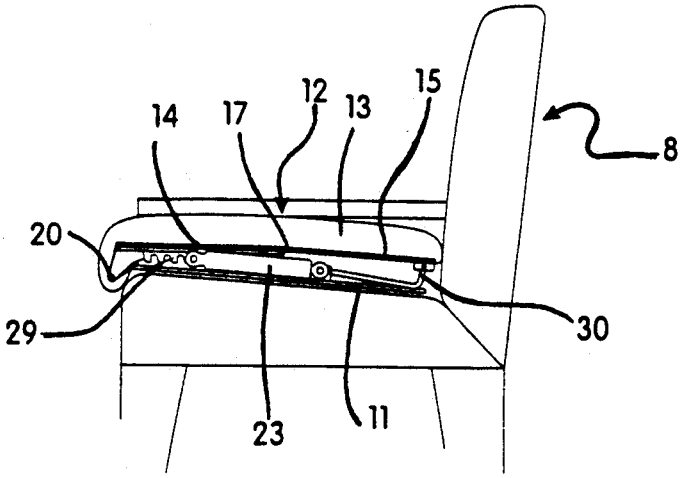
FIGS. 2, 3 and 4 are side views showing the raising of the occupier assisting section from the seated position to the elevated position.
Figure 3:
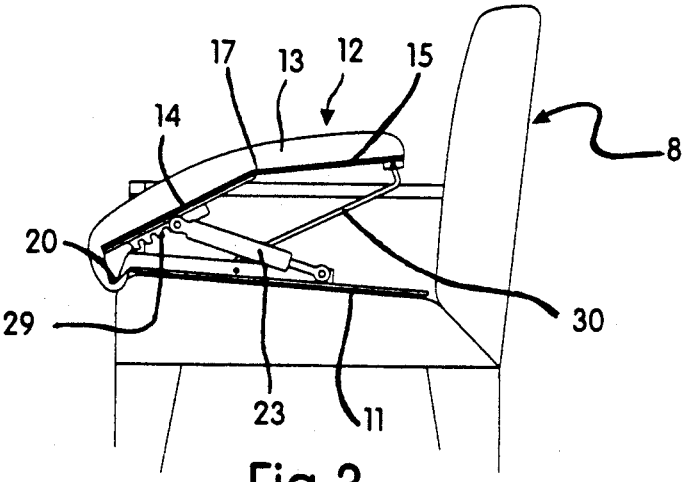
Figure 4:
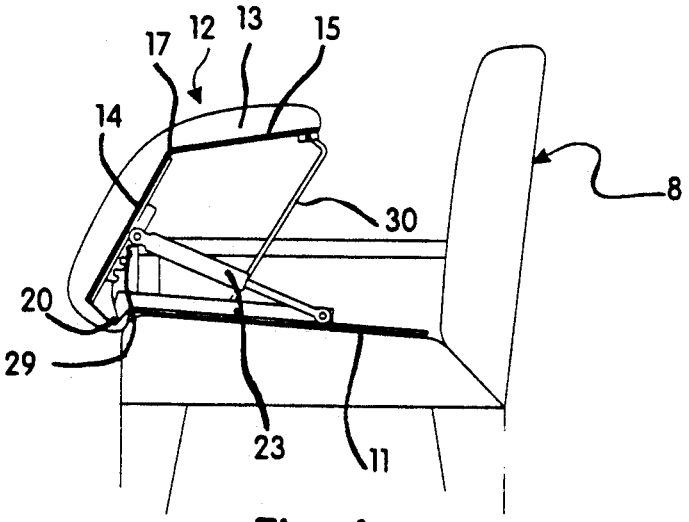

The rear end of the spring 23 is connected pivotally to the base 11 by a base pin 24. This pin connects to the base itself or, in the embodiment shown, the base 11 is provided with two arms 25 which serve as a fastening points for the base pin 24. The arms 25 also serve to stiffen and strengthen the base panel 26 which may be made of a thin material allowing compliance with the curvature of various seating furniture surfaces. The arms 25 in this embodiment extend beyond the front of the base panel 26 and have holes at their ends to accept the front pivot 20. It will be noted particularly from the view in FIGS. 2, 3, and 4 that the base arms 25 and the forward arms 19 are extended so that the front pivot 20 is substantially below the plane of the base 11. The extension thus formed by the two sets of arms 25 and 19 may advantageously be covered by the upholstered cushion 13 as also shown in FIG. 2, 3 and 4. The extension thereby also forms a stop which assists the user in stabilizing the device upon the chair 22 and prevents its sliding backward.

Also pivotally connected between the base 11 and seating surface 12 is a simple link means 30 connected at pivot points 31 on the base sheet 26 and at similar pivots 32 on the occupant assisting section 15 of the flexible platform 16. The link means 30 may be formed from a single piece of metal rod as shown in FIG. 5. The base pivots 31 may be incorporated into the base sheet 11 or the base arms 25. However, it is advantageous to place them near to the outer edges of the base 11 to afford the greatest stability if the base sheet 11 is flexible. The link means is of a length and position so that it is parallel and adjacent to the base 11 when the device is in the seated position as shown in FIG. 2. The link means 30 may have various small bends to advantageously provide support points between the seat 12 and base 11 when in the seated position. The apparatus will also function perfectly well without the link means.

Figure 6:
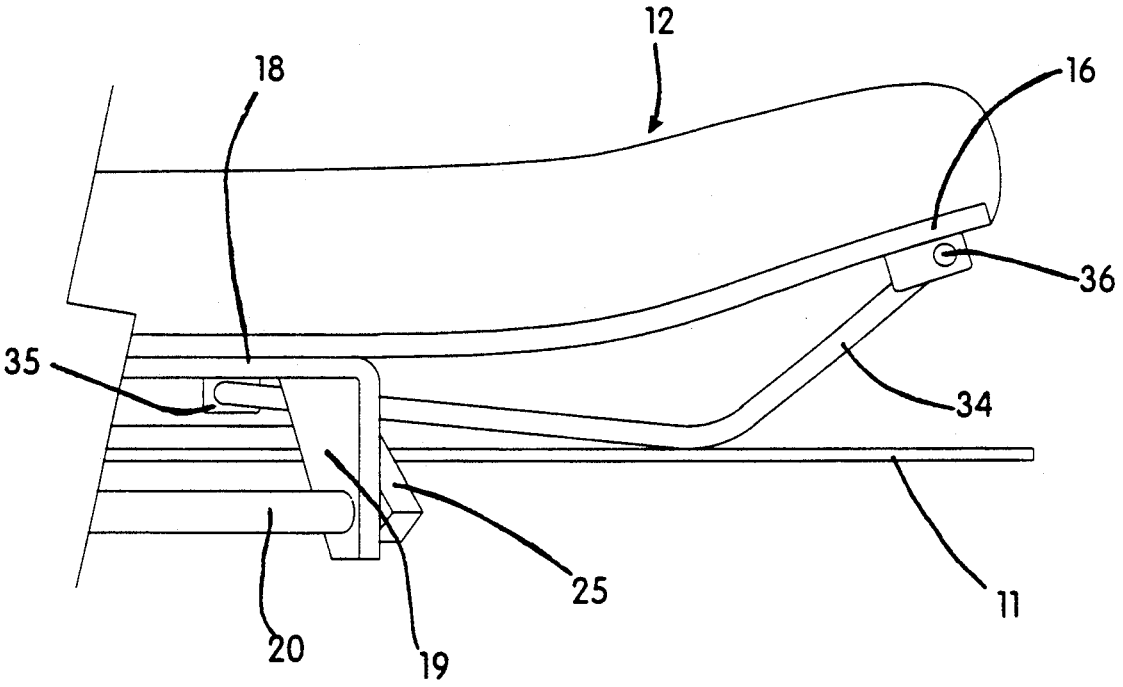
FIG. 6 is an oblique front view of the preferred embodiment showing one of the optional lifting levers.

An enhancement to the invention is shown in FIG. 5 and FIG. 6. A pair of simple levers 34 is provided at the forward corners of and on the underside of the front section 14. In the preferred embodiment, the levers 34, which are simple sections of bent rod, are pivotally attached to the stiffener 18 at pivots 35 and to the front corners of the flexible platform element 16 at pivots 36. In the seated position as shown in FIG. 6, the apex of the lever 34 bears upon the base 11 and causes the front corners of the seating surface 12 to curve upwardly.

OPERATION

In operation, the seat assist is placed upon the horizontal surface of a chair. The hook formed by the extensions of the arms 19 and 25 as well as the non-skid surface provide a safe and secure placement on a wide variety of seating furniture. The first operation is to set the spring for the weight of the user.

The spring pin 27 can be easily removed from a position between any two pairs of teeth 29 by pivoting upward the seating surface 12 away from the base 11 and replacing the front spring pin in a new position. The choice of receiving spaces between the teeth 29 is chosen to allow a range of lifting forces on the seating surface 12 from the spring 23 appropriate to the range of body weights of users of the device. The recesses between the teeth 29 have beside them printed numbers which serve as an indication of the appropriate user weight for each setting. It has been found that an upward force of 50 to 60% of the body weight of the individual is most appropriate although the best setting is a matter of user preference.

When the device is in the elevated position as shown in FIG. 4, the link means 30 causes the flexure between the front section 14 and occupant assisting section 15 at the flexible hinge region 17 and provides that the occupant assisting section 15 is at an orientation horizontally-suitable for seating. This provides a stable and comfortable seating surface when in the intermediate and elevated positions. Because the flexible platform element 16 is stressed in these positions, the spring force thus produced serves-to keep the front spring pin 27 securely located in the recess between adjacent teeth 29. This force is easily opposed for changing the force settings as has been described.

For use in sitting down, the user sits upon the occupant assisting section 15 and, leaning back slightly, the seat 12 starts to close upon the base 11. As it does so the spring 23 partially opposes the user's weight and stores potential energy which will be later used on lifting. The fact as noted that the front pivot 20 is located well below the plane of the base 11, means that there is no abrupt fall-off in lifting force as the unit closes completely as there would be if the pivot pin 20 and the front spring pin 18 and rear pin 14 were all coplanar. The effect of this offset is that the compressive force of the spring 23 when in the seated position creates a moment about the front pivot 20 thus providing a lifting force at the seated position as shown in FIG. 2. The upward force on occupant assisting section 15 at the seated position should be neither so small that the user falls into the seat with a jarring motion and has difficulty in initiating the rising motion nor so large that the user experiences an uncomfortable rising tendency in the seated position. It has been found that a ratio of 3:1 between the upward force at occupant assisting section 15 at the elevated versus seated positions is most appropriate. This ratio is a function of not only the offset distance but also the characteristics of the spring. FIG. 4*a* shows a further detail of this configuration which is advantageous: There is a small acute angle between the rows of teeth 29 and the base 11 when the device is in the seated position. This angle provides that the moment arm is less when the front spring pin 27 is positioned at the further forward, i.e.: the 3:1 ratio is roughly maintained even at the weaker settings.

For transportation and storage, the front spring pin is removed from the teeth 29 and the spring 23 is allowed to pivot down flat against the base 11. The seating surface 12 can be closed upon the base 11, the forward teeth 29 clearing the pin and allowing a non-energized and compact configuration for the device when not in use.

The link means 30 assists in providing stable posterior support for the user. While the link means forms an advantageous design, the seat assist still functions without it. In this simpler configuration, the flexibility and inherent spring force of the occupant assisting section 15 of the flexible element 37 provides adequate stability for the user. In this case, the teeth 29 may be provided with spring detent features to engage the front spring pin 27 or the bushings 28 in a snap fit an prevent their inadvertent disengagement.

Some users may not use an armchair or have access to stabilizing handles while rising. For this application the improvement shown in FIG. 1 and FIG. 6 is described. The lifting levers 34 cause the two forward corners of the seat 12 to curve upwards when in the seated position. When the user in the seated position bears down on these corners with the palms of the hands, a substantial upward force is developed prying apart the seat 12 from the base 11 which easily initiates the rising motion. This has been found to greatly increase the ease of use of the device on chairs without arms, sofas and the like.

The flexible hinge region 17 has been described as a flexible plastic "living hinge" but it may also be a conventional pinned hinge and may have a torsion spring to acheive the same effect.

Though it is useful as a lightweight portable device to be used on many chairs, the seat assist described may be incorporated into a dedicated chair, by making the base 11 a permanent part of the chair structure.

It should be understood that the invention should not be limited to the precise details of structure shown and set forth in the specification, for obvious modifications will occur to those skilled in the art to which the invention pertains.

I claim:

1. In a device for use with a chair wherein a power source is provided to raise the seating surface from a lowered position to an elevated position to assist an occupant to rise from the chair and to restrain the speed of return of the seating surface from the elevated position to the lowered position as an occupant seats himself in the chair, the improvement comprising:

a base;

a seat mounted to the base and having an occupant assisting section and a front seat section hingedly connected thereto;

link means hingedly connected to the occupant assisting section;

said front seat section hingedly connecting to said base and said link means hingedly connecting to said base, the said hinged connections each being about horizontal axes and at substantially the same elevation whereby to form a linkage system operable to move the occupant assisting section between a lowered position where it combines with the front seat section to form the seating surface with the front seat section overlying said base in juxtaposed relation thereto and with the occupant assisting section overlying said link means in juxtaposed relation thereto and an elevated position where the occupant assisting section is distance upwardly and forwardly from its lowered position at an orientation horizontally-suitable for seating and elevated from said base and the front seat section of the seating surface slopes downwardly and forwardly therefrom;

said power source hingedly connected to said base and to said front seat section.

2. In a device for use with a chair as claimed in claim 1 wherein the front seat section is hingedly connected to the base at an elevation slightly below the elevation of the hinged connection of the link means to the base whereby to increase the elevating power of the power means at the lowered position of the occupant assisting section.

3. In a device for use with a chair as claimed in claim 1 wherein the power source includes pneumatic means operatively connected between said front seat section and said base.

4. In a device for use with a chair as claimed in claim 1 wherein the power source includes a pneumatic cylinder and piston assembly operatively connected between said front seat section and said base and means for manually adjusting the place of connection of the assembly to the front seat section to manually vary the power to adapt to the weight of the occupant.

5. In a device for use with a chair as claimed in claim 1 wherein said front seat section and said occupant assisting section constitute a seating unit that comprises a sheet of flexible material flexible between its ends to constitute the hinged connection between the front section and the occupant assisting section, a sheet of inflexible material laminated to the sheet of flexible material under the front seat section thereof to define the location of the hinged connection between the front seat section and the occupant assist section of the seating unit.

6. In a device for use with a chair as claimed in claim 5 wherein a flexible cushion overlays said sheet of flexible material.

7. In a device for use with a chair as claimed in claim 5 or claim 6 having lever means with levers that connect at each of their ends to a platform element formed on said front seat section and having a fulcrum that bears on said base when said seating surface is in a lowered position whereby downward force on the seat overlying one end of a lever causes an upward force at the seating surface at the other end of the lever whereby to initially assist an occupant leaving the seat.

* * * * *